US009604813B1

(12) United States Patent
Herrmann et al.

(10) Patent No.: US 9,604,813 B1
(45) Date of Patent: Mar. 28, 2017

(54) DUAL VACUUM BELT SYSTEM WITH ADJUSTABLE INTER-COPY GAP

(71) Applicant: Xerox Corporation, Norwalk, CT (US)

(72) Inventors: Douglas K. Herrmann, Webster, NY (US); Jason M. LeFevre, Penfield, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/070,036

(22) Filed: Mar. 15, 2016

(51) Int. Cl.
*B65H 29/24* (2006.01)

(52) U.S. Cl.
CPC . *B65H 29/242* (2013.01); *B65H 2301/44322* (2013.01); *B65H 2301/44336* (2013.01); *B65H 2404/269* (2013.01); *B65H 2406/3222* (2013.01)

(58) Field of Classification Search
CPC .. B65H 5/224; B65H 29/242; B65H 2404/26; B65H 2404/269; B65H 2406/3124; B65H 2406/32; B65H 2301/44322; B65H 2406/3222; B65H 2301/44336
USPC ..... 271/276, 196, 197
See application file for complete search history.

(56) References Cited

U.S. PATENT DOCUMENTS 4,298,277 A 11/1981 Silverberg
4,411,420 A * 10/1983 Louis ..... B65H 5/224 271/197
4,776,577 A * 10/1988 Marschke ..... B65H 29/6618 271/151
4,825,255 A 4/1989 Iaia, Jr. et al.
5,671,300 A 9/1997 Adachi
5,967,507 A 10/1999 Moore et al.
5,967,510 A 10/1999 Ono et al.
7,922,174 B2 4/2011 Panides et al.
8,177,231 B2 5/2012 Fukui et al.
8,186,675 B2 5/2012 Zirilli
8,708,135 B2 4/2014 Lin et al.
2002/0171196 A1* 11/2002 Lehmann ..... B65H 5/224 271/197
2015/0158673 A1* 6/2015 Lenser ..... B65G 15/58 198/617

* cited by examiner

*Primary Examiner* — David H Bollinger
(74) *Attorney, Agent, or Firm* — Gibb & Riley, LLC

(57) ABSTRACT

A sheet transport apparatus includes a first belt having a first pattern of first vacuum holes, and a second belt having a second pattern of second vacuum holes. The first belt is positioned on and contacts the second belt. The first belt contacts sheets to be transported. When transporting the sheets on the first belt separated by spaces between the sheets, the first pulleys and second pulleys rotate together and the first belt and the second belt move together. When not transporting the sheets, a controller controls pulleys to move the first belt relative to the second belt so as to leave blocked-hole regions of the first belt where the spaces between the sheets are located. The blocked-hole regions are locations of the first belt where the first vacuum holes are unaligned with the second vacuum holes and the first vacuum holes are blocked by the second belt.

20 Claims, 10 Drawing Sheets

DUAL VACUUM BELT SYSTEM WITH ADJUSTABLE INTER-COPY GAP

BACKGROUND

Devices and methods herein generally relate to sheet transport devices, and more particularly to vacuum transport belts.

Various printer systems use vacuum transport belts to hold down and transport print media past printheads. Airflow disturbances at the inter-copy gap (ICG) from the vacuum system can cause leading edge and trailing edge (of the print media) disturbances that affect ink droplet placement and degrade the overall print quality. In other words, the vacuum holes at the leading edge and trailing edge gaps of the print media sheets can draw air from under the print heads and disturb the ink droplet dispersion, decreasing print quality.

SUMMARY

Various exemplary sheet transport apparatuses herein include a wider first belt on a first set of wider first pulleys overlapping a narrower second belt on a second set of narrower second pulleys (e.g., the second belt is between the first belt and the second pulleys.

The first and second belts contact one another and are parallel to one another, and the belts move in the same directions, but in different parallel planes. As noted, the first belt is wider than the second belt and the first pulleys are wider than the second pulleys, allowing relative rotation of the first pulleys and the second pulleys (e.g., rotation of the first and second pulleys at different speeds) to move the first belt relative to the second belt, as the first belt slides over the second belt.

The first belt has a first pattern of first vacuum holes, and the second belt has a second pattern of second vacuum holes that is different from the first pattern of first vacuum holes. For example, the first pattern of the first vacuum holes can be a uniform pattern and the second pattern of the second vacuum holes can be a non-uniform pattern (or vice versa).

Additionally, a vacuum source is adjacent the first belt (the second belt is between the first belt and the vacuum source). The first belt is positioned on and contacts (overlaps) the second belt so that one's of the first vacuum holes align with the second vacuum holes, but others of the first vacuum holes are blocked from the vacuum source by the second belt.

The first belt is the belt that contacts sheets to be transported. When transporting the sheets on the first belt (separated by inter-copy gap (ICG) spaces between the sheets) the first pulleys and second pulleys rotate together and, therefore, the first belt and the second belt move together. However, when not transporting the sheets a controller (that is electrically connected to the first pulleys and the second pulleys) controls the first pulleys to rotate relative to the second pulleys to move the first belt relative to the second belt so as to leave "blocked-hole regions" of the first belt where the ICG spaces between the sheets are located. Such "blocked-hole regions" are locations of the first belt where the first vacuum holes are unaligned with the second vacuum holes and the first vacuum holes are blocked from the vacuum source by the second belt.

As noted above, the first pattern of first vacuum holes are different from the second pattern of second vacuum holes, and this causes the relative movement of the first belt to the second belt to change the size and or location of the blocked hole regions, so as to accommodate different sized spaces between the sheets.

Various sheet transport methods herein determine the locations of ICG spaces between sheets to be transported on the first belt (that, again, is positioned on the first pulleys). These methods rotate the first pulleys and second pulleys together to move the first belt and a second belt on the second pulleys together when transporting the sheets (under control of the controller). However, such methods rotate the first pulleys relative to the second pulleys to move the first belt relative to the second belt when not transporting the sheets.

As discussed above, the first pulleys are adjacent the second pulleys, the first belt has a first pattern of first vacuum holes, and the second belt has a second pattern of second vacuum holes different from the first pattern of first vacuum holes. Also, a vacuum source is adjacent the second belt. The second belt is between the first belt and the vacuum source, and the first belt is positioned on the second belt so that one's of the first vacuum holes align with the second vacuum holes and others of the first vacuum holes are blocked from the vacuum source by the second belt. The rotating of the first pulleys relative to the second pulleys is controlled by a controller to move the first belt relative to the second belt, so as to leave the blocked-hole regions of the first belt where the ICG spaces between the sheets are located. Again, the blocked-hole regions are locations where the first vacuum holes are unaligned with the second vacuum holes and the first vacuum holes are blocked from the vacuum source by the second belt.

These and other features are described in, or are apparent from, the following detailed description.

BRIEF DESCRIPTION OF THE DRAWINGS

Various exemplary devices and methods are described in detail below, with reference to the attached drawing figures, in which.

DETAILED DESCRIPTION

Figure 1:
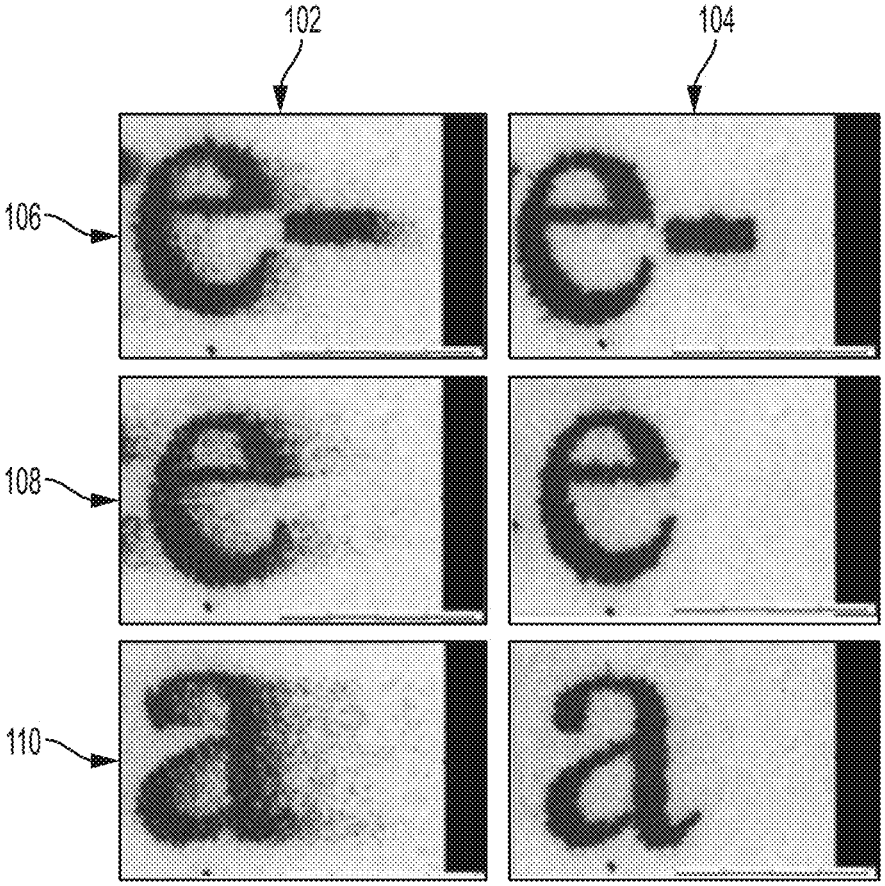
FIG. 1 is a close-up diagram illustrating a sheet of media effected by vacuum airflow.

As mentioned above, airflow disturbances at the inter-copy gap (ICG) from the vacuum system can cause leading edge and trailing edge (of the print media) disturbances that affect ink drop placement and degrade print quality. FIG. 1 illustrates undesirable effects of air being drawn into vacuum holes that are close to the trailing or leading edges of the media, where column 102 illustrates the effects of air being drawn into vacuum holes adjacent the trailing edge of a sheet of media, and column 104 illustrates the effects of the devices and methods herein which prevent air from being drawn into vacuum holes that are close to the trailing or leading edges of the sheet of media. In FIG. 1, row 106 illustrates the outboard portion out a sheet of media, row 108 illustrates the center of the sheet of media, and row 110 illustrates the inboard edge of the sheet of media. As can be seen in column 102 of FIG. 1, the airflow from the vacuum holes creates turbulence around the jets, and the ink droplets are deflected from their intended trajectory, shown in the increased blurring in column 102 (which is contrasted by the systems and devices herein, which produce the clearer results shown in column 104 in FIG. 1).

Figure 2:
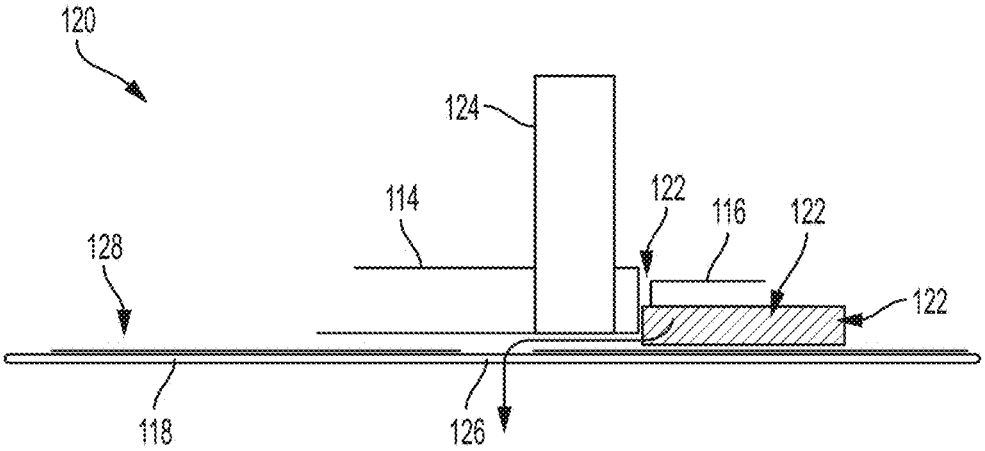
FIG. 2 is a side view schematic diagram illustrating a portion of sheet transport device.

FIG. 2 is a side-view schematic diagram illustrating a portion of a printing device 120. The printhead 124 is supported in a frame 114, along with a baseplate 116. The air drawn by the vacuum belt 118 is shown as items 122, and such air 122 is drawn through the open areas to the inter-copy gap 126 between the sheet of media 128, causing a disturbance at the leading and trailing ends of the sheet of media 128. FIG. 2 shows that the air disturbance 122 flows down through the inter-copy gap 126 between the sheets of print media 128, and causes the undesirable ink droplets deflection illustrated in column 102 in FIG. 1.

Thus, for print engine systems that use a vacuum belt transport to transport the media under an ink jet print system, the area where no sheet is present (at the inter-copy gap 126) creates unwanted airflow 122 by the print heads 124. This airflow 122 creates turbulence around the jets and the ink droplets are deflected from their intended trajectory, which leads to degraded print accuracy and a distorted image. With no media to block the airflow 122 caused by the vacuum, the air is pulled by the ink jet head 124 and this air velocity 122 causes dispersion of the jetted ink droplets between the head 124 and the sheet 128. This error is in evidence at both the leading edge and trailing edge of the print media sheets, and can been in column 102 in FIG. 1.

The devices and methods described below control the vacuum to be present only under the media 128 and not at the inter-copy gap 126. The print media sheet 128 however needs to have vacuum up to the edges, so a permanent change in the underlying plenum would prevents any vacuum under the print head 124, which might lead to the print media separating from the belt in the area of the print head 124, and create an uneven print surface.

In view of such issues, the devices and methods herein use a dual coaxial vacuum belt system to create a dynamic inter-copy gap that moves with the sheets as the print media sheets are transported under the print heads. By creating a closed inter-copy gap that moves with the sheets, the devices and methods herein eliminate vacuum at the inter-copy gap (while still providing full vacuum beneath the sheet at all times) and air disturbances at the leading and trailing edges of the sheets are reduced or eliminated, even as the print media sheets transition under the print heads.

The devices and methods herein provide full vacuum under the print media as the print media traverses the entire print path, and these systems provide for a no-vacuum inter-copy gap that moves along with the print media sheets under the print heads. This is accomplished with a dual vacuum inner/outer belt system. This system is made up of an outer belt that has a matrix of holes that allows for full coverage of the vacuum with a second underlying (inner) belt that is shifted to align a second set of holes to match the sheet pitch. The holes within a row are aligned from outer belt to inner belt so that the vacuum is present only under the sheet, and the holes are blocked at the inter-copy gaps.

Figure 3:
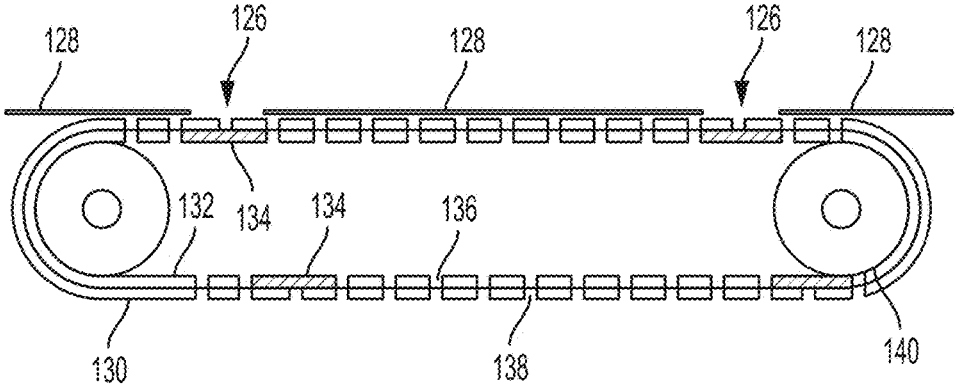
FIG. 3 is a side view schematic diagram illustrating a portion of sheet transport devices herein.

For example, FIG. 3 illustrates that the inter-copy gap 126 is between the sheets of media 128. FIG. 3 also illustrates an outer belt 130 and an inner belt 132 that are rotated via the pulley system (item 140). The different belts 130, 132 have different vacuum hole spacing 136, 138 that is offset, creating a vacuum-blocked inter-copy gap 126 for the sheet size 128 being printed. More specifically, FIG. 3 illustrates that a portion 134 inner belt 132 covers the inter-copy gap 126 and prevents air from being drawn through vacuum holes 138 of the outer belt 130.

Figure 4:
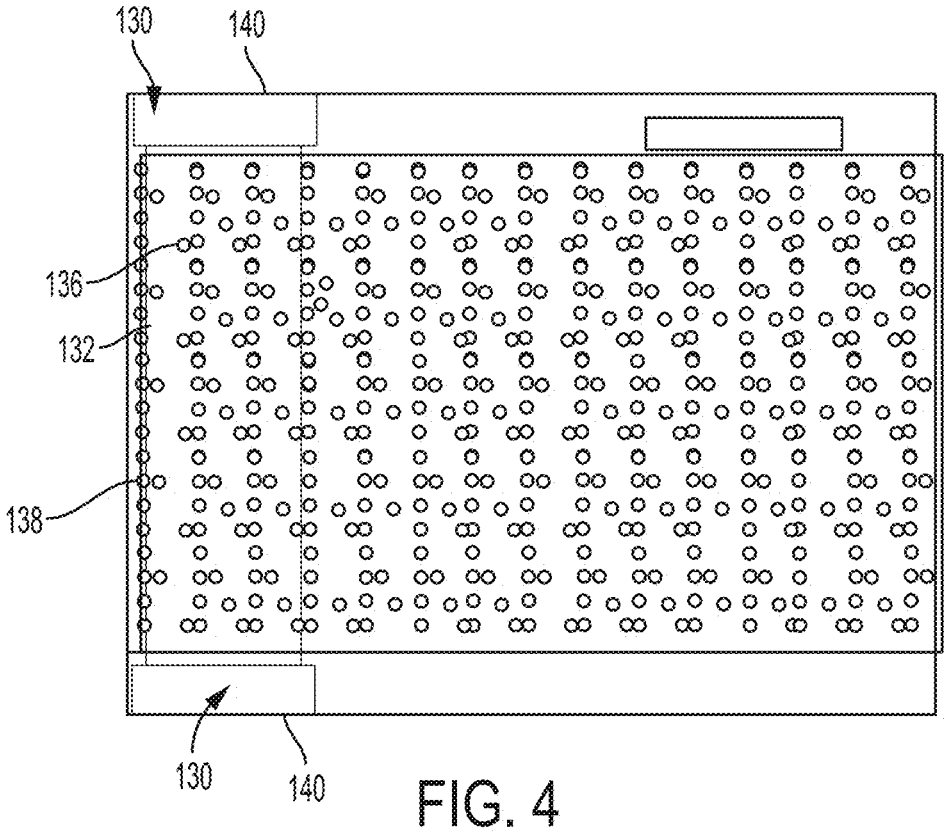
FIG. 4 is a top view schematic diagram illustrating a portion of sheet transport devices herein.
Figure 5A:
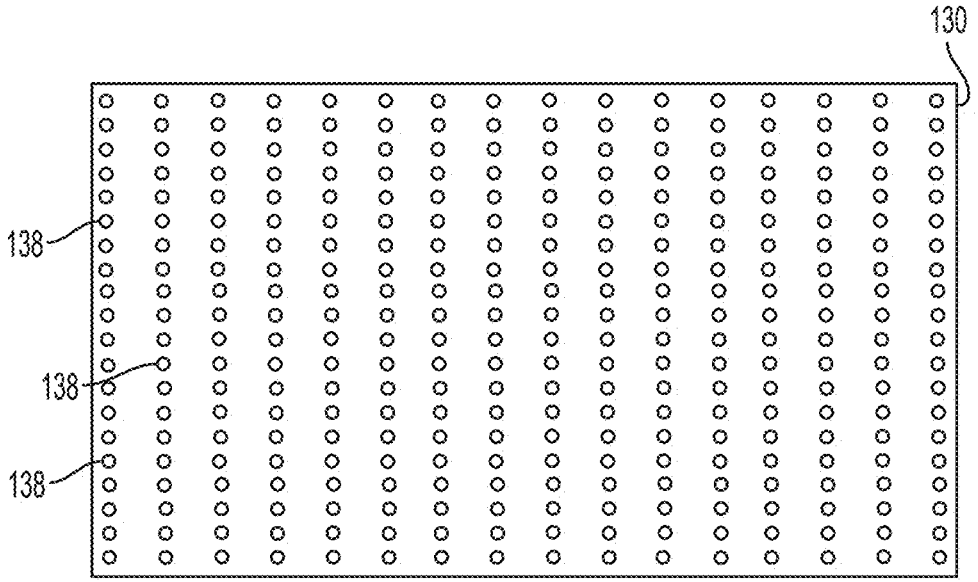
FIGS. 5A and 5B are top view schematic diagrams illustrating a portion of sheet transport devices herein.
Figure 5B:
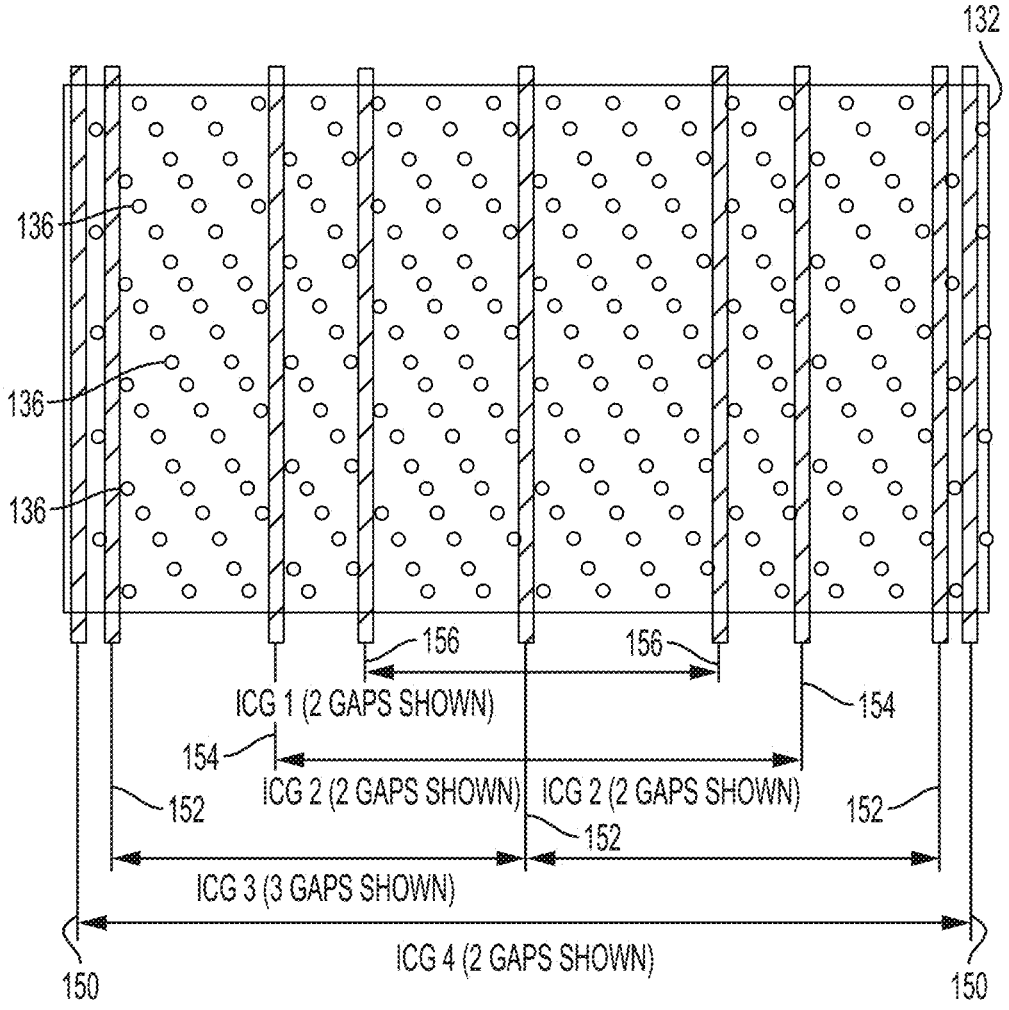

FIG. 4 illustrates a top down view of overlapped belts 130, 132 with independent drive systems 140 to allow for dual belt hole alignment. FIG. 4 illustrates the belt hole matrix 136 of the inner belt 132. As also shown in FIG. 4, the outer belt 130 includes a pattern of vacuum holes 138. FIGS. 5A-5B show the belts 130, 132 that overlapped in Figure separated. More specifically, FIG. 5A illustrates the regular pattern of vacuum hole openings 138 that are within the outer belt 130 (without showing the inner belt 132). To the contrary, FIG. 5B illustrates the irregular pattern of vacuum hole openings 136 of the inner belt 132 (without showing the outer belt 130).

FIG. 5B also illustrates various areas of the inner belt 132 that will create blocked-hole regions 134 when the inner belt 132 is positioned at different locations relative to the outer belt 130, and such regions 134 are shown as items 150, 152, 154, and 156 in FIG. 5B. For example, if a relatively small sheet is being transported on the outer belt 130, the inner belt 132 can be positioned to align the blocked-hole regions 156 with the vacuum hole openings 138 of the outer belt 130 (e.g., an ICG 1 measure). If a larger sheet is being transported on the outer belt 130, the inner belt 132 can be positioned to align the blocked-hole regions 154 with the vacuum hole openings 138 of the outer belt 130 (e.g., an ICG 2 measure). Similarly, if an even larger sheet is being transported on the outer belt 130, the inner belt 132 can be positioned to align the blocked-hole regions 152 with the vacuum hole openings 138 of the outer belt 130 (e.g., an ICG 3 measure). As an additional example, if a yet larger sheet is being transported on the outer belt 130, the inner belt 132 can be positioned to align the blocked-hole regions 150 with the vacuum hole openings 138 of the outer belt 130 (e.g., an ICG 4 measure). Therefore, FIGS. 5A-5B illustrate that by changing the relative positions of the inner belt 132 and the outer belt 130, the positions (and potential sizes) of the blocked-hole regions 150, 152, 154, and 156 can be changed to accommodate different sizes and different locations of different inter-copy gaps that will be mandated by different sized sheets of media being transported on the outer belt 130.

Figure 6A:
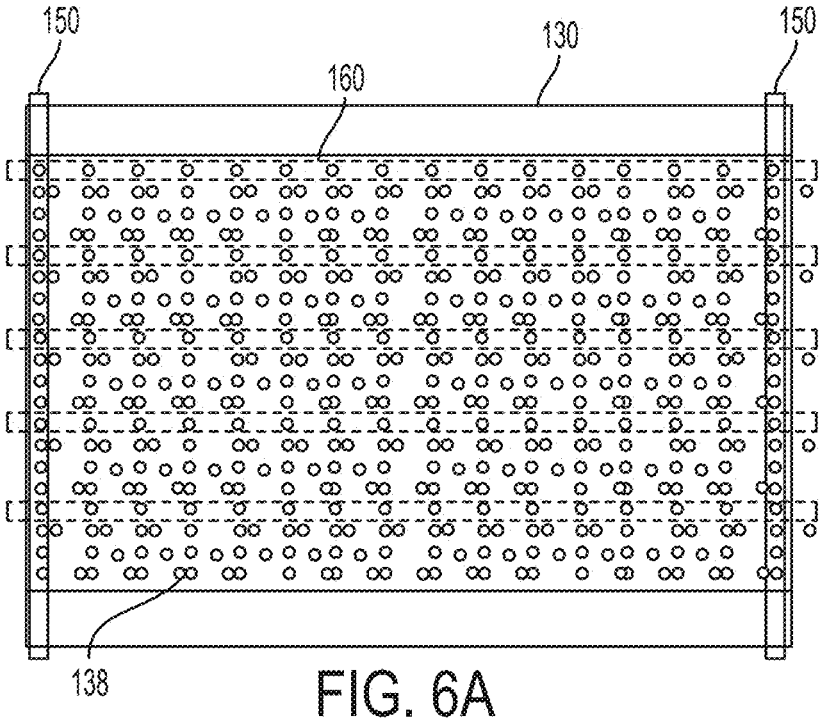
FIGS. 6A and 6B are top view schematic diagrams illustrating a portion of sheet transport devices herein.
Figure 6B:
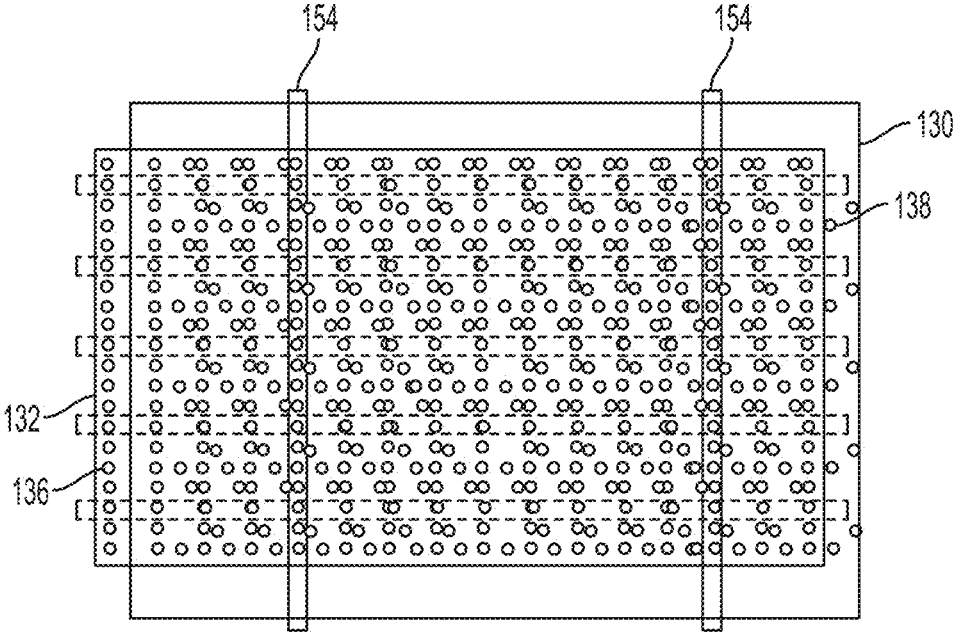

FIGS. 6A-6B illustrate the situation where the outer belt 130 has an irregular pattern of vacuum hole openings 138, while the inner belt 132 has a regular pattern of vacuum hole openings 136. FIGS. 6A-6B also illustrate how the relative positions of the belts 130, 132 create block-hole regions 150

Figure 7:
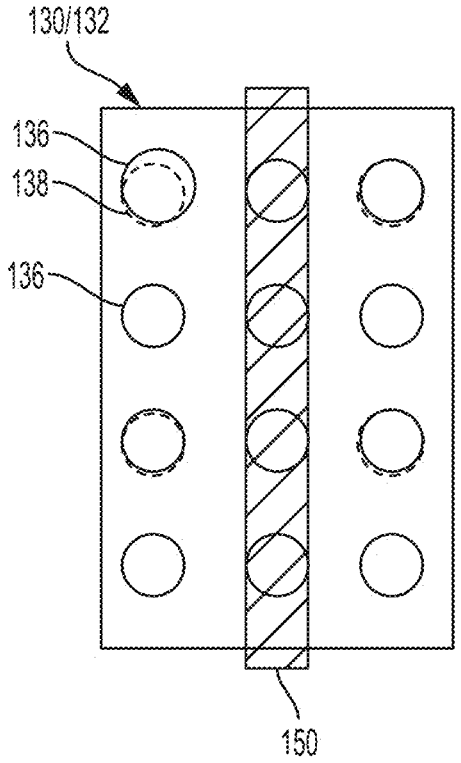
FIG. 7 is a top view diagram illustrating a portion of sheet transport devices herein.

(FIG. 6A) and 154 (FIG. 6B) that are similar to the block-hole regions 150, 154 shown in FIG. 5B. FIG. 7 also illustrates the overlapped belts 130, 132 and how the vacuum hole openings 136 of the inner belt 132 sometimes align with the vacuum hole openings 138 (shown using dashed line circles) of the outer belt 130, and sometimes do not. This allows the creation of the block-hole regions 150.

Therefore, as shown in FIGS. 1-7, multiple rows are used so that the hole patterns on the inner belt repeat at a specific row multiples, providing for several pitch timing and inter-copy gaps. By shifting the inner belt in relation to the outer belt, a combination set of holes is aligned to provide a full vacuum across the sheet, while a column of holes is blocked to provide the non-vacuum inter-copy gap. In this way, the non-vacuum inter-copy gap travels with the sheets as the sheets are transported under the ink jet heads. As the print media sheets transition from the trailing edge of the previous sheet to the leading edge of the next sheet, no open vacuum belt holes are present to create the vacuum induced air disturbance under the print heads. The belts are each indexed on separate coaxial drives to align the holes of the inner belt to the holes of the outer belt so that the non-vacuum inter-copy gap and pitch for that sheet size is created.

Thus, the inner and outer belts index relative to each other to establish the non-vacuum inter-copy gap set up for the size and spaced sheet that will be transported on the belts. The relative movement of the two belts only occurs when the machine is set-up for a run (i.e. during cycle-up), knowing the sheet-size and inter-document zone (IDZ) and the relative belt positions are adjusted to achieve the proper zone of holes blocked for the desired non-vacuum inter-copy gap or inter-document zone. Once the non-vacuum inter-copy gap is established, the belts move together at the same velocity, and the belt system is synchronous, and the print media sheets are introduced to the marking transport belt at a time and cadence to have the designated non-vacuum inter-copy gap to match the incoming sheets.

Figure 8:
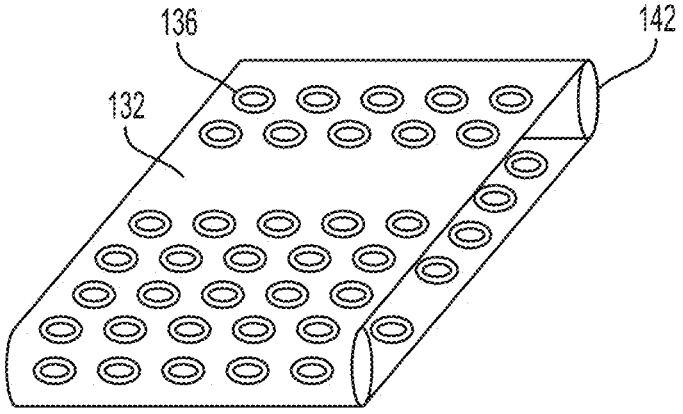
FIG. 8 is a perspective schematic diagram illustrating a portion of sheet transport devices herein.

FIGS. 8-12 illustrate the various components that make up one example of the sheet transportation apparatuses disclosed herein. More specifically, FIG. 8 illustrates the second pulleys 142, the second belt 132, and the second vacuum holes 136 that extend through the second belt 132 and that are in the second pattern. Note that the components shown in FIG. 8 would not normally be visible, and therefore are shown alone in FIG. 8, without the overlying components that are described in more detail and FIGS. 9-12.

Figure 9:
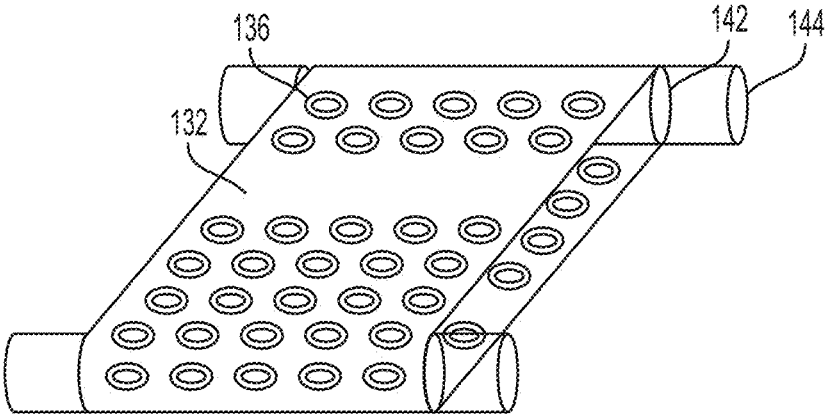
FIG. 9 is a perspective schematic diagram illustrating a portion of sheet transport devices herein.

In addition to those elements shown in FIG. 8, FIG. 9 illustrates the first pulleys 144 (in transparent view to allow the other components to still be illustrated). As can be seen in FIG. 9, the first pulleys 144 are co-axle with the second pulleys 142. This means that the line (axle) upon which the second pulleys 142 rotate lies along the same line (axle) upon which the first pulleys 144 rotate. Additionally, the first pulleys 144 are wider than the second pulleys 142 (in the direction of the axles). Further, the first pulleys 144 have a larger diameter than the second pulleys 142, and this increase in diameter is equal to or greater than the thickness of the second belt 132. This allows the first pulleys 144 to have an outer diameter that matches or is greater than the outer diameter of the second belt 132 mounted on the second pulleys 142, which permits the first pulleys 144 to make good contact with the first belt 130. As shown in FIG. 9, at each end of the belts, a second pulley 142 is positioned between two outer first pulleys 144, and the first pulleys 144 are independently rotatable relative to the second pulley 142 that is between them to allow the belts 130, 132 to be moved relative to one another.

Figure 10:
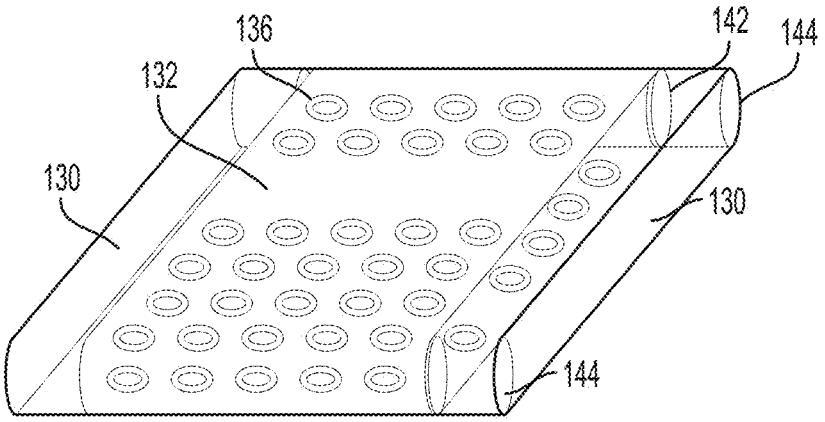
FIG. 10 is a perspective schematic diagram illustrating a portion of sheet transport devices herein.
Figure 11:
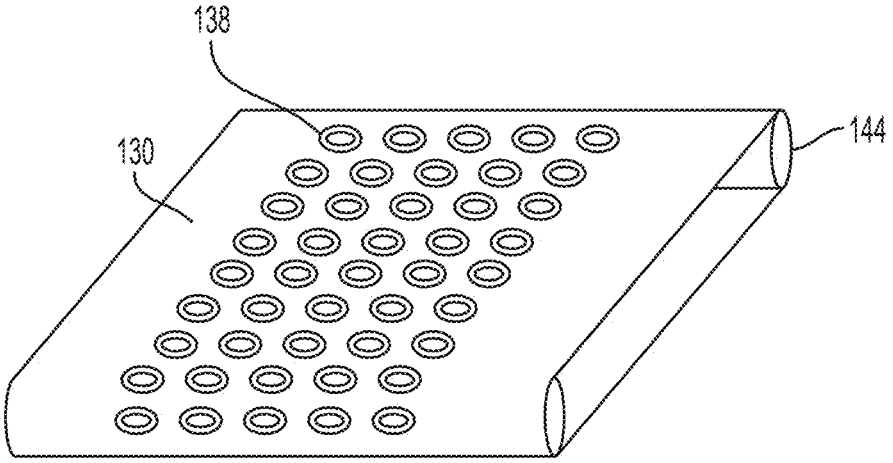
FIG. 11 is a perspective schematic diagram illustrating a portion of sheet transport devices herein.

In addition to the elements shown in FIG. 9, FIG. 10 illustrates the first belt 130 (also in transparent view to allow the remaining components to be illustrated). FIG. 10 does not illustrate the first vacuum holes 138, as such elements are shown in FIG. 11. Because the first belt 130 is shown in transparent view, it can be seen in FIG. 10 that the first belt 130 is wider than the second belt 132, and that the first belt 130 extends wide enough to contact the wider first pulleys 144. Additionally, FIG. 10 illustrates that the first belt 130 contacts and overlaps the second belt 132, and that the second belt 132 is positioned between the first belt 130 and the second pulleys 142.

The first belt 130 can slide over to the second belt 132 because the coefficient of friction between the first belt 130 and the first pulleys 144 is greater than the coefficient of friction between the first belt 130 and the second belt 132. Therefore, rotation of the first pulleys 144 without rotation of the second pulleys 142 (or rotation of the first and second pulleys 144, 142 at different speeds) causes the first belt 130 to move relative to the second belt 132. Similarly, rotation of the second pulleys 142 without rotation of the first pulleys 144 causes the second belt 132 to slide beneath the first belt 130 because the second pulleys 142 do not contact the first belt 130, and only contact the second belt 132.

Again, FIG. 11 illustrates the second belt 130, but this time not in transparent view, which causes the first belt 130 to hide all the elements shown in FIG. 8; however, even though they are not illustrated in FIG. 11, such elements are still in place in FIG. 11. As can be seen by comparing the first pattern of the first vacuum holes 138 that extend through the first belt 130 with the second pattern of second vacuum holes 136, the first and second patterns are different. In this example, the first pattern is uniform, while the second pattern is not uniform and includes breaks between the rows of second vacuum holes 136 (although the opposite could be the case, or both belts could have non-uniform patterns of vacuum holes). While some specific patterns of vacuum holes are illustrated in the various drawings herein, those ordinarily skilled in the art would understand that any combination of different patterns of vacuum holes could be utilized with the structures herein, with the proviso that relative movement between the belt causes the size and/or locations of the blocked-hole regions 134 to change so as to match different spaces between the sheets of media that will be transported by the first belt 130.

Therefore, as shown in perspective view in FIGS. 8-12, exemplary sheet transport apparatuses herein include a wider first belt 130 on a first set of wider first pulleys 144 overlapping a narrower second belt 132 on a second set of narrower second pulleys 142 (e.g., the second belt 132 is between the first belt 130 and the second pulleys 142). As shown, the first and second belts 132 contact one another and are parallel to one another, and the belts move in the same directions, but in different parallel planes. As noted, the first belt 130 is wider than the second belt 132 and the first pulleys 144 are wider than the second pulleys 142, allowing relative rotation of the first pulleys 144 and the second pulleys 142 (e.g., rotation of the first and second pulleys 142 at different speeds) to move the first belt 130 relative to the second belt 132, as the first belt 130 slides over the second belt 132.

Again, the first belt 130 has a first pattern of first vacuum holes 138, and the second belt 132 has a second pattern of second vacuum holes 136 that is different from the first pattern of first vacuum holes 138. For example, the first pattern of the first vacuum holes 138 can be a uniform pattern and the second pattern of the second vacuum holes 136 can be a non-uniform pattern.

Figure 12:
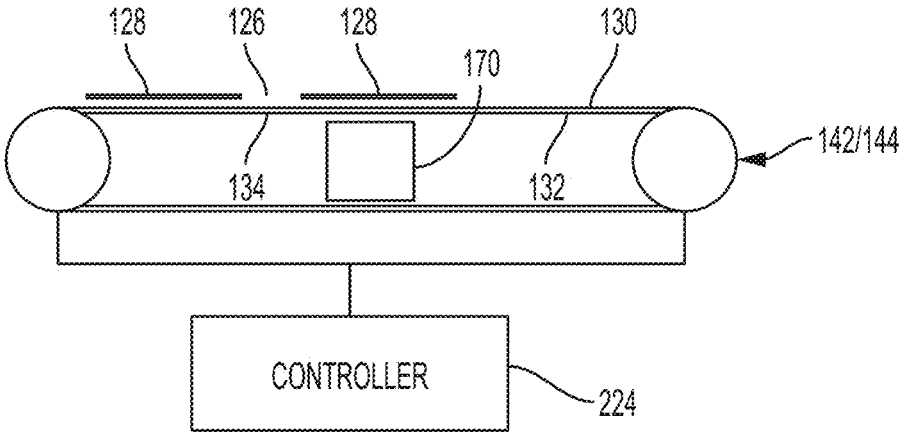
FIG. 12 is a side-view schematic diagram illustrating a portion of sheet transport devices herein.

Additionally, as shown in FIG. 12, a vacuum source 170 is adjacent the first belt 130 (the second belt 132 is between the first belt 130 and the vacuum source 170). The first belt 130 is positioned on and contacts (overlaps) the second belt 132 so that one's of the first vacuum holes 138 align with the second vacuum holes 136, but others of the first vacuum holes 138 are blocked from the vacuum source 170 by the second belt 132 (creating what is sometimes referred to herein as blocked-hole regions 134 of the first belt 130).

As is understood by those ordinarily skilled in the art, the vacuum source 170 generally includes a fan and ductwork that draws air out of the space between the pulleys (142/144) to create an area of lower than atmospheric pressure (a vacuum) within the space between the pulleys (142/144). The vacuum source 170 draws air through the vacuum holes 136, 138, but only in locations where the first and second vacuum holes 138, 136 are partially or fully aligned. Thus, in locations where the first vacuum holes 138 contact the continuous (unbroken, non-hole) surface of the second belt 132, the first vacuum holes 138 are blocked from the vacuum source 170 by the continuous surface of the second belt 132 (which is a blocked-hole region 134) and air will not be drawn into the first vacuum holes 138 that are within the blocked-hole regions 134.

As also shown in FIG. 12, the first belt 130 is the belt that contacts sheets 128 to be transported. When transporting the sheets 128 on the first belt 130 (separated by spaces 134 between the sheets 128) the first pulleys 144 and second pulleys 142 rotate together and, therefore, the first belt 130 and the second belt 132 move together. However, when not transporting the sheets 128, a controller 224 (that is electrically connected to the first pulleys 144 and the second pulleys 142) controls the first pulleys 144 to rotate relative to the second pulleys 142 to move the first belt 130 relative to the second belt 132 so as to leave blocked-hole regions 134 of the first belt 130 where the spaces 126 between the sheets 128 are located. Such blocked-hole regions 134 are locations of the first belt 130 where the first vacuum holes 138 are unaligned with the second vacuum holes 136 and the first vacuum holes 138 are blocked from the vacuum source 170 by the second belt 132.

As noted above, the first pattern of first vacuum holes 138 are different from the second pattern of second vacuum holes 136, and this causes the relative movement of the first belt 130 to the second belt 132 to change the size and or location of the blocked hole regions 134, so as to accommodate different sized spaces 134 between the sheets 128.

Figure 13:
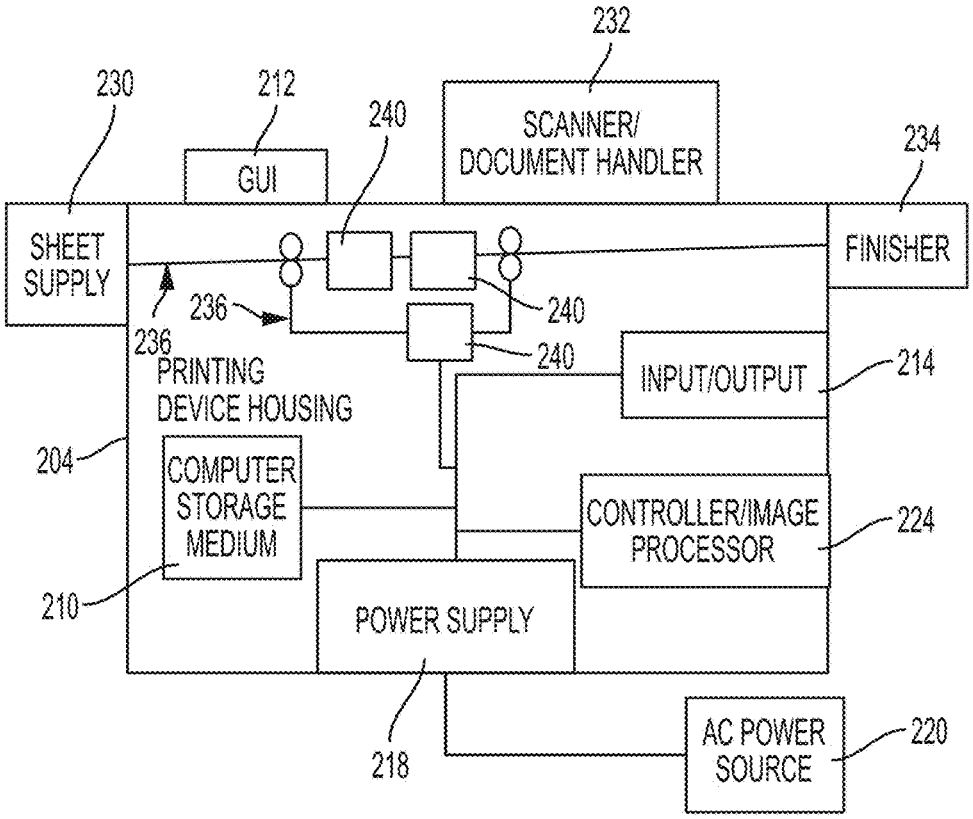
FIG. 13 is a schematic diagram illustrating devices herein.

FIG. 13 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 13, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 that use marking material, and are operatively connected to a specialized image processor 224 (that is different than a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Figure 14:
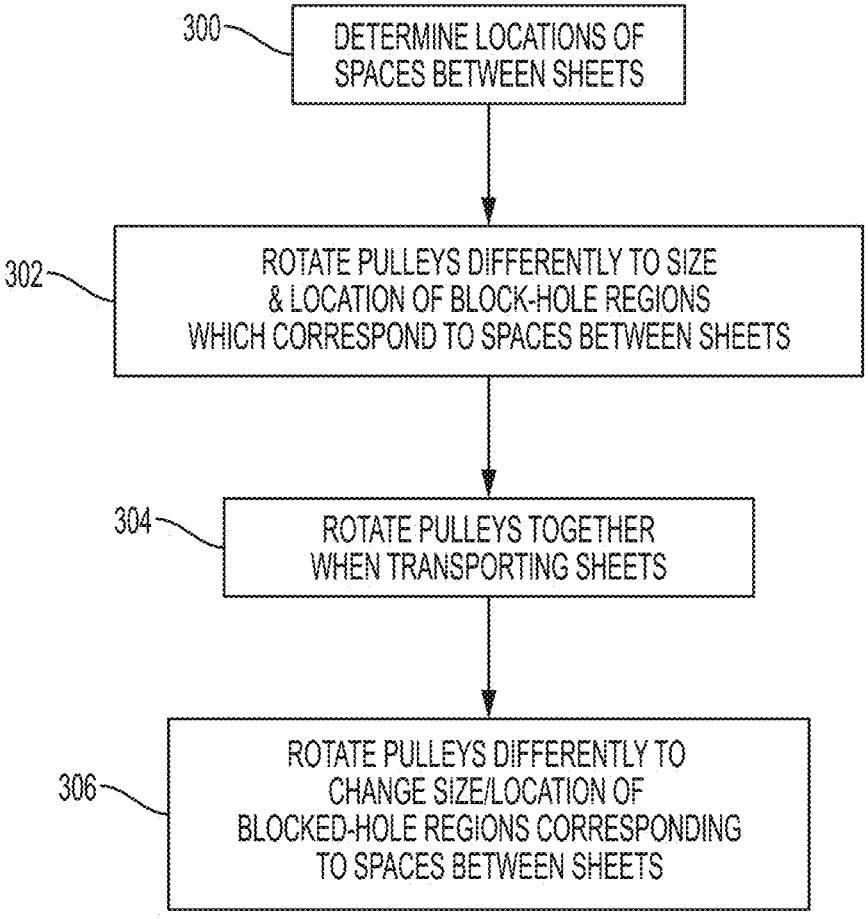
FIG. 14 is a flow diagram of various methods herein.

FIG. 14 is a flowchart that methods performed by various devices described herein. As shown in FIG. 14, these methods determine the locations of spaces between sheets to be transported on the first belt (that, again, is positioned on the first pulleys) in item 300. In item 302, these methods rotate the first pulleys and second pulleys differently to the size and location of the block-hole regions which correspond to the spaces between the sheets. In item 304 these methods rotate the first pulleys and second pulleys together to move the first belt and a second belt on the second pulleys together when transporting the sheets (under control of the controller). However, in item 306, such methods rotate the first pulleys relative to the second pulleys to move the first belt relative to the second belt when not transporting the sheets in order to change the size and/or location of the blocked-hole regions that correspond to the spaces between sheets.

As discussed above, the first pulleys are adjacent the second pulleys, the first belt has a first pattern of first vacuum holes, and the second belt has a second pattern of second vacuum holes different from the first pattern of first vacuum holes. Also, a vacuum source is adjacent the second belt. The second belt is between the first belt and the vacuum source, and the first belt is positioned on the second belt so that ones of the first vacuum holes align with the second vacuum holes and others of the first vacuum holes are blocked from the vacuum source by the second belt. The rotating of the first pulleys relative to the second pulleys is controlled by a controller to move the first belt relative to the second belt, so as to leave the blocked-hole regions of the first belt where the spaces between the sheets are located. Again, the blocked-hole regions are locations where the first vacuum holes are unaligned with the second vacuum holes and the first vacuum holes are blocked from the vacuum source by the second belt.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the devices and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The devices and methods herein can encompass devices and methods that print in color, monochrome, or handle color or monochrome image data. All foregoing devices and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

What is claimed is:

1. A sheet transport apparatus comprising:

first pulleys;

a first belt on said first pulleys, said first belt has a first pattern of first vacuum holes;

second pulleys adjacent said first pulleys;

a second belt on said second pulleys, said second belt has a second pattern of second vacuum holes; and a controller electrically connected to said first pulleys and said second pulleys, said first belt is positioned on and contacts said second belt, said first belt contacts sheets to be transported, when transporting said sheets on said first belt separated by spaces between said sheets, said first pulleys and second pulleys rotate together and said first belt and said second belt move together, and when not transporting said sheets, said controller controls said first pulleys to rotate relative to said second pulleys to move said first belt relative to said second belt so as to leave blocked-hole regions of said first belt where said spaces between said sheets are located, said blocked-hole regions are locations of said first belt where said first vacuum holes are unaligned with said second vacuum holes and said first vacuum holes are blocked by said second belt.

2. The sheet transport apparatus according to claim 1, said first pattern of first vacuum holes being different from said second pattern of second vacuum holes causes relative movement of said first belt to said second belt to change at least one of the size of said blocked hole regions and the location of said blocked hole regions to accommodate different sized spaces between said sheets.

3. The sheet transport apparatus according to claim 1, said first pattern of said first vacuum holes is a uniform pattern and said second pattern of said second vacuum holes is a non-uniform pattern.

4. The sheet transport apparatus according to claim 1, said second belt is between said first belt and said second pulleys.

5. The sheet transport apparatus according to claim 1, said first belt is wider than said second belt and said first pulleys are wider than said second pulleys, allowing relative rotation of said first pulleys and said second pulleys to move said first belt relative to said second belt.

6. A sheet transport apparatus comprising:
first pulleys;
a first belt on said first pulleys, said first belt has a first pattern of first vacuum holes;
second pulleys adjacent said first pulleys;
a second belt on said second pulleys, said second belt has a second pattern of second vacuum holes different from said first pattern of first vacuum holes;
a controller electrically connected to said first pulleys and said second pulleys; and
a vacuum source adjacent said second belt,
said second belt is between said first belt and said vacuum source,
said first belt is positioned on and contacts said second belt so that ones of said first vacuum holes align with said second vacuum holes and others of said first vacuum holes are blocked from said vacuum source by said second belt,
said first belt contacts sheets to be transported,
when transporting said sheets on said first belt separated by spaces between said sheets, said first pulleys and second pulleys rotate together and said first belt and said second belt move together, and
when not transporting said sheets, said controller controls said first pulleys to rotate relative to said second pulleys to move said first belt relative to said second belt so as to leave blocked-hole regions of said first belt where said spaces between said sheets are located,
said blocked-hole regions are locations of said first belt where said first vacuum holes are unaligned with said second vacuum holes and said first vacuum holes are blocked from said vacuum source by said second belt.

7. The sheet transport apparatus according to claim 6, said first pattern of first vacuum holes being different from said second pattern of second vacuum holes causes relative movement of said first belt to said second belt to change at least one of the size of said blocked hole regions and the location of said blocked hole regions to accommodate different sized spaces between said sheets.

8. The sheet transport apparatus according to claim 6, said first pattern of said first vacuum holes is a uniform pattern and said second pattern of said second vacuum holes is a non-uniform pattern.

9. The sheet transport apparatus according to claim 6, said second belt is between said first belt and said second pulleys.

10. The sheet transport apparatus according to claim 6, said first belt is wider than said second belt and said first pulleys are wider than said second pulleys, allowing relative rotation of said first pulleys and said second pulleys to move said first belt relative to said second belt.

11. A sheet transport method comprising:
determining locations of spaces between sheets to be transported on a first belt positioned on first pulleys;
rotating said first pulleys and second pulleys together to move said first belt and a second belt on said second pulleys together when transporting said sheets; and
rotating said first pulleys relative to said second pulleys to move said first belt relative to said second belt when not transporting said sheets,
said first pulleys are adjacent said second pulleys,
said first belt has a first pattern of first vacuum holes,
said second belt has a second pattern of second vacuum holes,
said first belt is positioned on said second belt so that ones of said first vacuum holes align with said second vacuum holes and others of said first vacuum holes are blocked by said second belt,
said rotating said first pulleys relative to said second pulleys is controlled by a controller to move said first belt relative to said second belt so as to leave blocked-hole regions of said first belt where said spaces between said sheets are located,
said blocked-hole regions are locations where said first vacuum holes are unaligned with said second vacuum holes and said first vacuum holes are blocked by said second belt.

12. The sheet transport method according to claim 11, said first pattern of first vacuum holes being different from said second pattern of second vacuum holes causes relative movement of said first belt to said second belt to change at least one of the size of said blocked hole regions and the location of said blocked hole regions to accommodate different sized spaces between said sheets.

13. The sheet transport method according to claim 11, said first pattern of said first vacuum holes is a uniform pattern and said second pattern of said second vacuum holes is a non-uniform pattern.

14. The sheet transport method according to claim 11, said second belt is between said first belt and said second pulleys.

15. The sheet transport method according to claim 11, said first belt is wider than said second belt and said first pulleys are wider than said second pulleys, allowing relative rotation of said first pulleys and said second pulleys to move said first belt relative to said second belt.

16. A sheet transport method comprising:
determining locations of spaces between sheets to be transported on a first belt positioned on first pulleys;
rotating said first pulleys and second pulleys together to move said first belt and a second belt on said second pulleys together when transporting said sheets; and
rotating said first pulleys relative to said second pulleys to move said first belt relative to said second belt when not transporting said sheets,
said first pulleys are adjacent said second pulleys,
said first belt has a first pattern of first vacuum holes,
said second belt has a second pattern of second vacuum holes different from said first pattern of first vacuum holes,
a vacuum source is adjacent said second belt,
said second belt is between said first belt and said vacuum source,
said first belt is positioned on said second belt so that ones of said first vacuum holes align with said second vacuum holes and others of said first vacuum holes are blocked from said vacuum source by said second belt,
said rotating said first pulleys relative to said second pulleys is controlled by a controller to move said first belt relative to said second belt so as to leave blocked-hole regions of said first belt where said spaces between said sheets are located, and
said blocked-hole regions are locations where said first vacuum holes are unaligned with said second vacuum holes and said first vacuum holes are blocked from said vacuum source by said second belt.

17. The sheet transport method according to claim 16, said first pattern of first vacuum holes being different from said second pattern of second vacuum holes causes relative movement of said first belt to said second belt to change at least one of the size of said blocked hole regions and the location of said blocked hole regions to accommodate different sized spaces between said sheets.

18. The sheet transport method according to claim 16, said first pattern of said first vacuum holes is a uniform pattern and said second pattern of said second vacuum holes is a non-uniform pattern.

19. The sheet transport method according to claim 16, said second belt is between said first belt and said second pulleys.

20. The sheet transport method according to claim 16, said first belt is wider than said second belt and said first pulleys are wider than said second pulleys, allowing relative rotation of said first pulleys and said second pulleys to move said first belt relative to said second belt.

* * * * *